US006175091B1

(12) United States Patent
Nishimura et al.

(10) Patent No.: US 6,175,091 B1
(45) Date of Patent: Jan. 16, 2001

(54) ROTARY TYPE ELECTRONIC COMPONENT AND MANUFACTURING METHOD OF THE SAME

(75) Inventors: Takahiro Nishimura; Tetsuya Fukuda, both of Okayama; Hiroshi Matsui, Osaka, all of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/426,274

(22) Filed: Oct. 25, 1999

(30) Foreign Application Priority Data

Oct. 23, 1998 (JP) ..... 10-302477

(51) Int. Cl.[7] ..... H01H 19/14
(52) U.S. Cl. ..... 200/571; 200/564; 200/11 R
(58) Field of Search ..... 200/11 R–11 K, 200/564, 565, 570, 571, 4, 336

(56) References Cited

U.S. PATENT DOCUMENTS

| | | | | |
|---|---|---|---|---|
| 3,819,883 | * | 6/1974 | Heap | 200/11 J |
| 4,359,711 | | 11/1982 | Tanabe et al. | 338/134 |
| 4,439,654 | | 3/1984 | Bresin et al. | 338/128 |
| 4,625,084 | * | 11/1986 | Fowler et al. | 200/11 DA |
| 4,719,324 | * | 1/1988 | Kuratani | 200/11 R |
| 5,291,177 | | 3/1994 | Chiu | 338/166 |
| 5,310,974 | * | 5/1994 | Churchill et al. | 200/566 |
| 5,491,462 | | 2/1996 | Cecchi et al. | 200/302.1 |
| 5,847,335 | * | 12/1998 | Sugahara et al. | 200/4 |
| 6,049,044 | * | 4/2000 | Mizobuchi | 200/4 |

* cited by examiner

*Primary Examiner*—Michael Friedhofer
(74) *Attorney, Agent, or Firm*—Ratner & Prestia

(57) ABSTRACT

A rotary type electronic component includes (a) a bearing formed of a cylindrical section and a substrate on which the cylindrical section is situated, (b) a rotary shaft formed of an upper section protruding from the bearing, a mid section journaled by the bearing, and a lower section having a flange with a hole which communicates with a recess formed axially in the shaft, (c) a case coupled with a lower face of the substrate so that the case covers the lower section of the shaft, and on its bottom plate having fixed contacts corresponding to movable contacts, (d) a spring housed in the recess of the shaft and biasing from inner section of the recess toward the bottom plate of the case, and (e) a frictional plate having a hole in the axial direction, engaging with a rim of recess opening, being urged by the spring against the bottom plate of the case, following the rotation of the shaft and yet moving axially and independently of the shaft. This construction allows the downsized component to keep required high torque with smooth tactile feel as well as a long service-life.

11 Claims, 5 Drawing Sheets

ROTARY TYPE ELECTRONIC COMPONENT AND MANUFACTURING METHOD OF THE SAME

FIELD OF THE INVENTION

The present invention relates to a rotary type electronic component which generates a given signal by rotating a rotary shaft, and it also relates to a method of manufacturing the same component.

BACKGROUND OF THE INVENTION

In recent years, electronic devices have been down sized and yet equipped with more functions, which demands the electronic components employed in those devices to be smaller in size. Torque of a rotary-type-electronic-component, in general, decreases at the smaller size of the component while the structure thereof is maintained. This drawback has been overcome, and downsized rotary type electronic components with given torque are prevailing in the market.

A rotary type encoder, as an example of the conventional rotary type electronic component, is described hereinafter with reference to FIGS. 4 and 5.

FIG. 4 is a side sectional view of a conventional high-torque rotary encoder, and FIG. 5 is an exploded perspective view of the same.

In FIGS. 4 and 5, rotary shaft 510 is made of resin, and its upper section works as an operating section 511. A lower section of shaft 510 has flange 512 formed integratively therewith. A mid section of shaft 510 forms cylindrical shaft 513 journaled by through-hole 521 boring in metal bearing 520. Grease of high viscosity is applied to the journaling section.

Beneath bearing 520, flange 512 and box-type case 530 made of resin are situated in tandem. Beneath the center of flange 512, positioning section 514 is provided, which is inserted into hole 531 provided on case 530 so that shaft 510 is jounraled by case 530.

Beneath flange 512, movable contact 540 made of resilient metal leaf is mounted. Movable contact 540 elastically contact to fixed contact 550 formed by contacts forming in radial on recessed base of case 530. Both the contacts form a contact section for producing pulse signals. Terminal 560 electrically conductive to fixed contact 550 extends outside case 530 from a side of case 530. Contact 540, 550 and terminal 560 form electric-signal-producing-section 570.

Metal cover 580 covers periphery of the base of bearing 520 and locks case 530. Between cover 580 and an upper face of case 530, a frame of spring 590 made of resilient metal leaf is rested. Resilient leg section 591 of spring 590 elastically contacts on step 515 of flange 512.

An operation of the rotary encoder constructed above is described as follows:

When operating section 511 of shaft 510 is rotated, flange 512 rotates accordingly. Then movable contact 540 elastically slides on fixed contact 550, thereby producing a pulse signal as a given electric signal. The pulse signal is taken out from a plurality of terminals 560.

Resilient leg 591 of spring 590 urges downwardly step 515 of flange 512 so that step 515 rotates. Shaft 510 thus obtains predetermined torque.

As discussed above, the conventional encoder is constructed such that shaft 510 can obtain high torque by urging elastically leg section 591 against step 515.

However, according to this construction, the outer diameter of leg section 591 of spring 590 is obliged to decrease at the narrower diameter of the electronic component, which weakens the urging force of leg section 591. In order to overcome this drawback, it is a general method that the elastic urging force of spring 590 is boosted considering the material and leaf thickness of spring 590. This method still has some limit, and if a greater urging-force of the spring can be produced, it would apply an intensive pressure to a local point on flange 512 where spring 590 urges. Even if grease is applied to the contact face, tactile feel at operating becomes worse, and the frictional faces are heavily worn out.

SUMMARY OF THE INVENTION

The present invention addresses the problems discussed above, and aims to provide a down-sized rotary type electronic component which still keeps required high and stable torque with smooth tactile feel as well as a long service-life. The present invention also aims to provide a manufacturing method of this component.

A rotary type electronic component of the present invention comprises the following elements:

(a) a bearing comprising: a cylinder section; and a substrate on which the cylinder section is rested, (b) a rotary shaft comprising:
- an upper section protruding from the bearing;
- a mid section journaled by the bearing; and
- a lower section comprising:
  - a flange formed around the lower section;
  - a hole punched through the flange; and
  - a movable contact disposed on a lower face of the flange,
- a recess axially provided in the rotary shaft and communicating with the hole through the flange;

(c) a case coupling to a lower face of the substrate of the bearing so that the case covers the lower section of the rotary shaft, and on a bottom plate thereof having a fixed contact corresponding to the movable contact;

(d) a spring housed by the recess of the rotary shaft, and urging the bottom plate of the case from an inner part of the recess;

(e) a frictional plate having a hole bored therethrough axially, engaging with an inlet rim of the recess prepared in the rotary shaft, being urged by the spring force against the bottom plate of the case, and rotating together with the rotary shaft; however, being axially movable independently of the rotary shaft.

This construction allows the flange of the shaft to contact with the substrate of the bearing in a wider area, which produces the greater friction. As a result, this downsized rotary type electronic component still keeps required high torque and smooth tactile feel as well as a long service-life.

A manufacturing method of the rotary type electronic component of the present invention comprises the following steps, where the component described above further includes a pole standing on the bottom of the recess provided in the rotary shaft. The pole extends through the spring and is press-fitted into the hole bored in the frictional plate with such a strength that the plate can move axially by a force not less than a biasing force of the spring, and yet weights of the spring and frictional plate are insufficient for themselves to come off from the pole. The manufacturing method comprises the steps of:

extending the pole through the hole bored in the frictional plate;

compressing the spring; and widening an end of the pole to form a stopper preventing the spring and the frictional plate from coming off from the pole so that the rotary shaft, spring and frictional plate are integrated.

DETAILED DESCRIPTION OF THE INVENTION

An exemplary embodiment of the present invention is demonstrated hereinafter with reference to the accompanying drawings.

Figure 1:
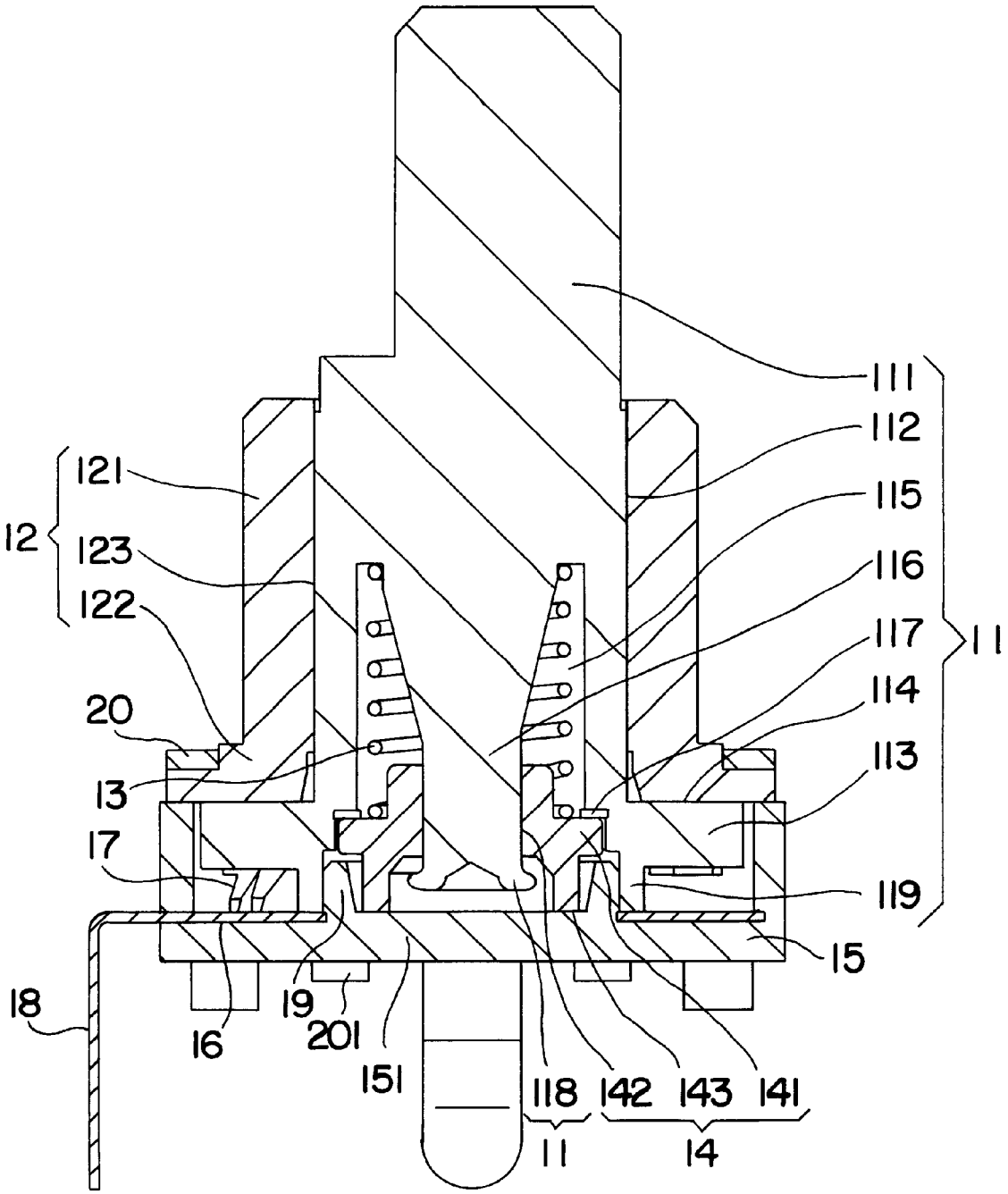
FIG. 1 is a side cross section of a rotary type electronic component (encoder) in accordance with an exemplary embodiment of the present invention.
Figure 2:
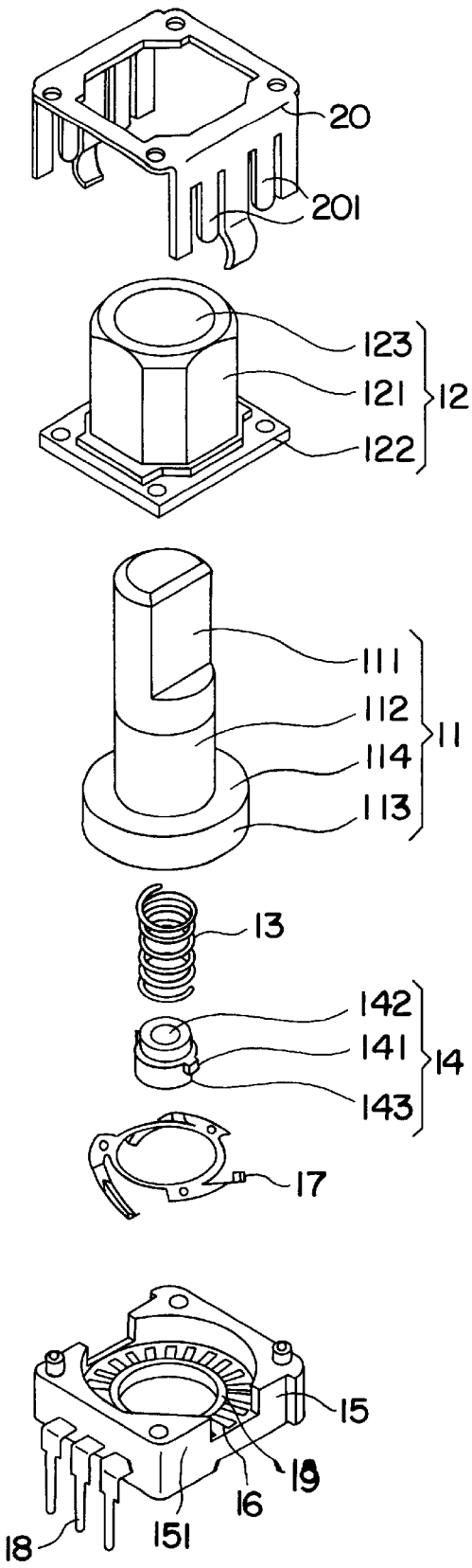
FIG. 2 is a perspective view of the same encoder.

FIG. 1 is a side cross section of a rotary type electronic component (encoder) in accordance with the exemplary embodiment of the present invention, and FIG. 2 is a perspective view of the same encoder.

In FIGS. 1 and 2, rotary shaft 11 is made of resin, and its upper section works as an operating section 111. A lower end of shaft 11 has flange 113 formed integratively therewith. Bearing 12 is made of metal, and comprises cylinder section 121 and substrate 122 on which cylinder section 121 is situated. A mid section of shaft 11 forms cylindrical shaft section 112 journaled by through-hole 123 extending through metal bearing 12. Grease of high viscosity is applied to the journaling section.

In this embodiment, upper face 114 of flange 113 is flat, and a lower face of substrate 122 of bearing 12 is also flat. These two flat faces solidly contact with each other, and grease of high viscosity is applied in between as lubricant. Recess 115 is axially provided at the center of shaft 11, and the lower end of shaft 11 is partially occupied by the opening of recess 115. Compression coil spring 13 axially stretching is disposed inside recess 115 along the inner wall of recess 115, of which bottom pole 116 stands on. Pole 116 extends through the center of spring 13 toward the opening of the recess.

In the opening of recess 115, ring-type frictional plate 14 made of resin is disposed so that plate 14 pushes to compress spring 13. Protrusion 141 on outer wall of frictional plate 14 engages with polygon section 117 disposed at the opening of recess 115. This construction allows frictional plate 14 to rotate with shaft 11, yet, plate 14 can move axially and independently of shaft 11. Into center hole 142 shaping in a circle of plate 14, pole 116 is press-fitted. Pole 116 has stood on the bottom plate of recess 115 in shaft 11.

Pole 116 is press-fitted into hole 142 of plate 14 with such strength that weights of spring 13 and frictional plate 14 are not enough to drop off spring 13 and plate 14 from pole 116 and frictional plate 14 moves axially by a force not weaker than the spring force urging plate 14 downwardly.

End 118 of pole 116 is flared so that shaft 11, spring 13 and plate 14 cannot come off after these three elements are integrated at the assembly of this rotary type encoder.

Beneath flange 113 and frictional plate 14, box-type case 15 made of resin is disposed in a form of being coupled to a periphery of the lower face of substrate 122. Grease of high viscosity is applied to a flat bottom plate 151 of case 15. Ring-shaped lower face 143 of frictional plate 14—biased by spring 13—elastically urges bottom plate 151 of case 15 with grease in between. Spring 13 biases shaft 11 upwardly, which urges upper face 114 of flange 113 against substrate 122 of bearing 12 via grease between these two flat plates.

Fixed contacts 16 are radially prepared on bottom plate of case 15, and movable contacts 17 made of resilient metal leaf held by the lower face of flange 113 elastically urges fixed contacts 16. Both the contacts form contacts for producing pulse signals. Terminals 18 conductive to fixed contacts 16 depend outside from the sides of case 15. These contacts and terminals form an electric signal generator.

On bottom plate 151 of case 15, a protruded rim is formed between contacts 16 and lower face 143. This protruded rim works as partition 19 which prevents grease of high viscosity—applied to the place where lower face 143 elastically urges bottom face 151—from flowing out to contacts 16. By engaging with ring-shaped protrusion 119 on the lower face of flange 113, partition 19 functions also as a position determiner for determining a relative position between shaft 11 and case 15.

Metal cover 20 is put on substrate 122 of bearing 12 and locks case 15 with its legs 201.

A method of assembling the rotary type encoder in accordance with this embodiment is demonstrated hereinafter.

Figure 3:
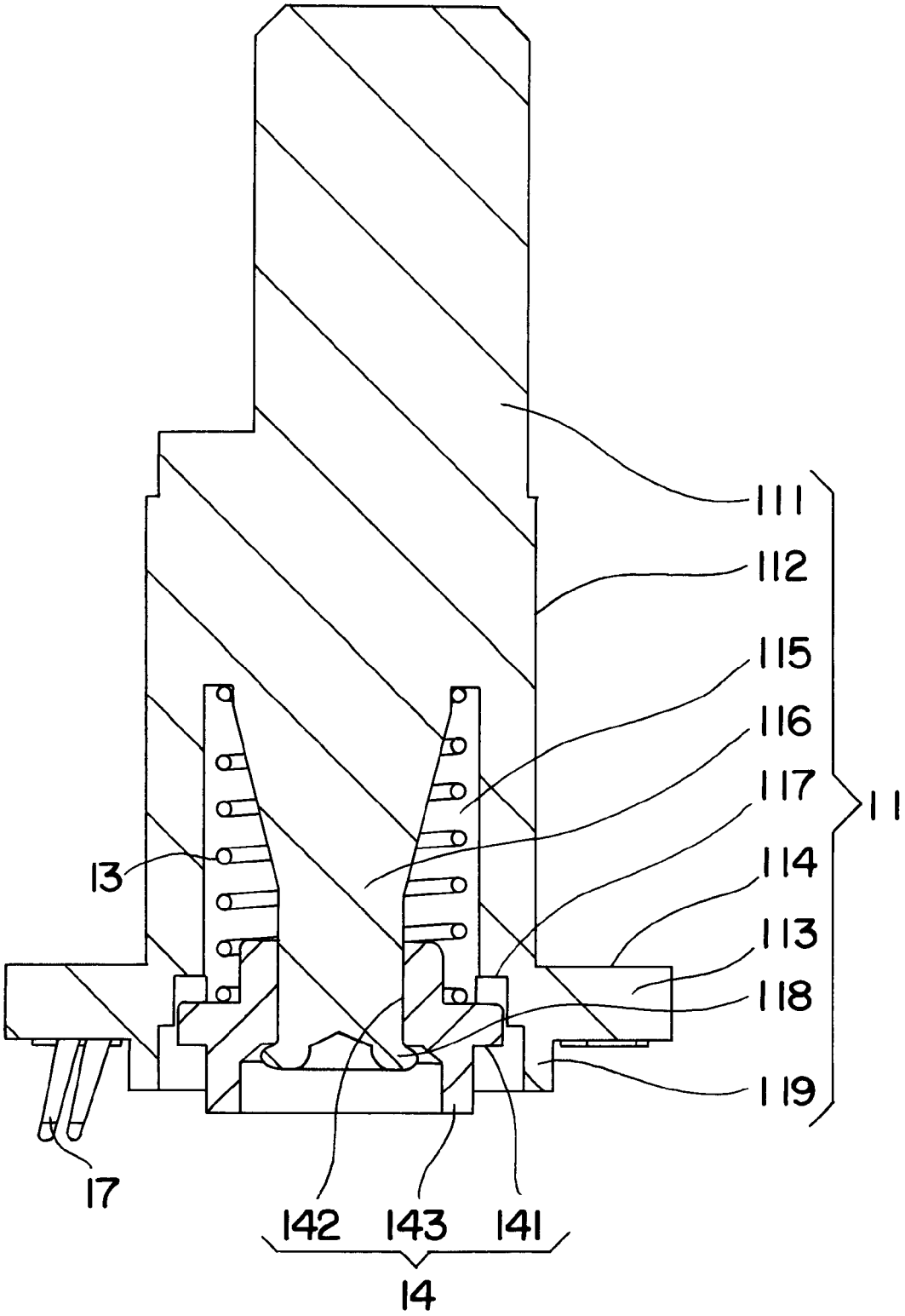
FIG. 3 is a cross section illustrating how to mount a compressed coil spring and a fractional plate to a rotary shaft of the encoder.
Figure 4:
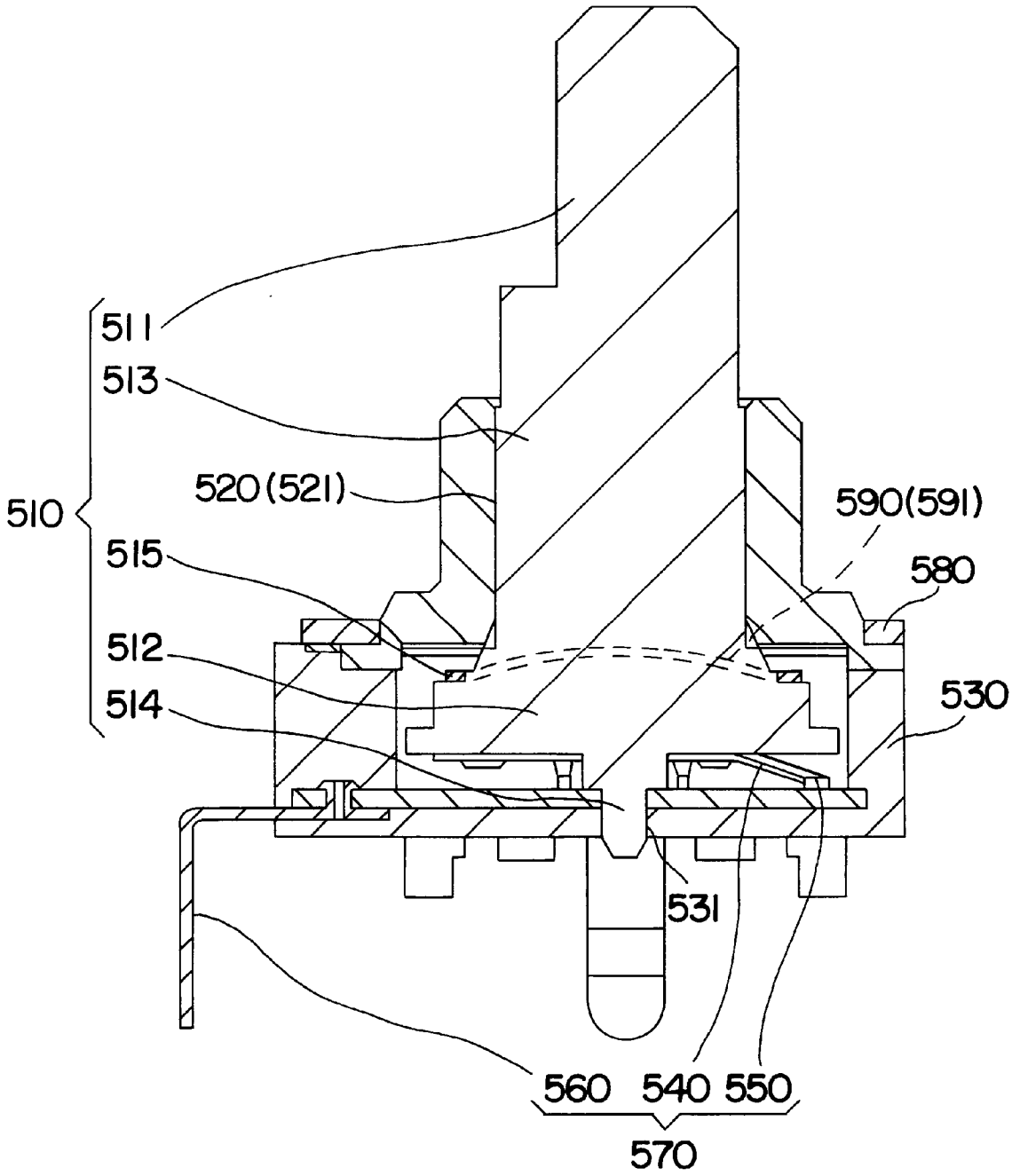
FIG. 4 PRIOR ART
FIG. 4 is a side cross section of a conventional rotary type encoder.
Figure 5:
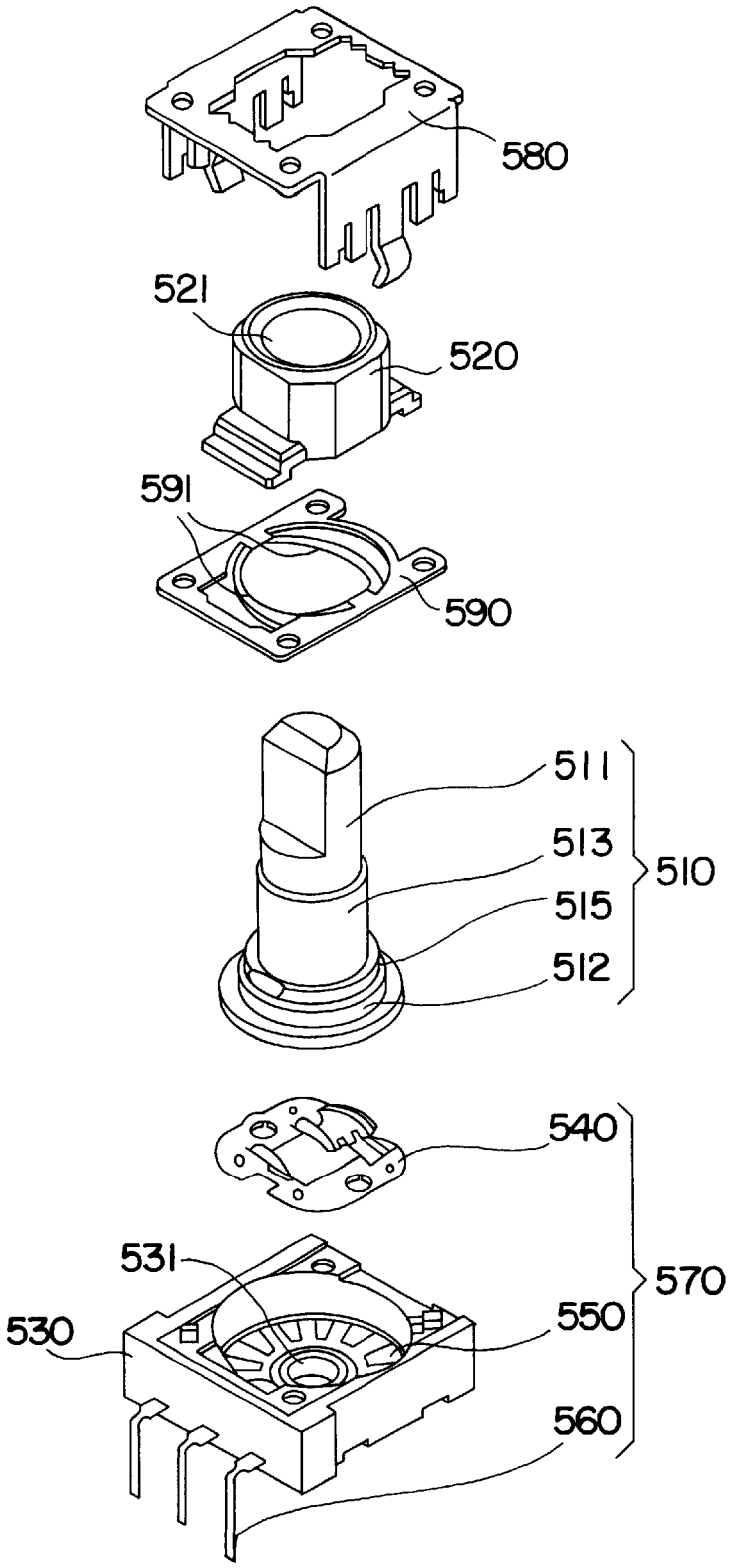
FIG. 5 PRIOR ART
FIG. 5 is a perspective view of the conventional rotary type encoder.

Rotary shaft assembly is assembled by mounting movable contacts 17, spring 13 and frictional plate 14 onto shaft 11. The assembling method is described below with reference to a sectional view shown in FIG. 3.

1. Insert compression-coil-spring 13 into recess 115 provided in shaft 11 so that spring 13 covers pole 116 of shaft 11. Before the insertion, movable contacts 17 have been caulked to the lower face of flange 113.

2. Press-fit a lower section of pole 116 into center-hole 142 of frictional plate 14, thereby mounting plate 14 to shaft 11.

3. Push plate 14 into recess 15, thereby compressing spring 13 to a degree so that protrusion 141 provided on an outer wall of plate 14 mates with polygonal section 117 provided at the opening of recess 115.

4. End 118 of pole 116 is widened by caulking, which prevents plate 14 from coming off from pole 116, thereby integrating shaft 11, spring 13 and frictional plate 14.

The rotary shaft assembly is thus completed.

5. Grease of high viscosity has been applied to the outer wall of cylindrical shaft 112 and the upper face of flange 113.

6. Grease of high viscosity has been also applied to flat bottom plate 151 of case 15.

An entire component is assembled following the steps below.

7. Insert the rotary shaft assembly discussed above into cylindrical through hole 123 bored in bearing 12 from the bottom.

8. Couple case 15 to the lower face of substrate 122. At this time, the upper face of flange 113 contacts to the lower face of substrate 122, and keeping this condition, frictional plate 14 is slightly pushed up by contacting ring-shaped lower face 143 of plate 14 to bottom plate 151 of case 15. This compresses spring 13 to a degree so that protrusion 141 deeply bites into polygonal section 117 of shaft 11 as well as spring 13 strongly urges the upper face of flange 13 against the lower face of substrate 122.

9. Put metal cover 20 on substrate 122 of bearing 12, and caulk legs 201 of cover 20 to the bottom plate of case 15 thereby locking case 15.

Through the steps discussed above, the rotary type encoder is assembled.

An operation of the encoder assembled above is described hereinafter.

When operating section 111 of shaft 11 is rotated, flange 113 rotates so that movable contacts 17 disposed on the lower face of flange 113 elastically slide with regard to fixed contacts 16. As a result, pulse signals are produced as electrical signals. The pulse signal can be taken out from terminals 18. At this moment, cylindrical shaft 112, on which grease of high viscosity is applied, rotates smoothly within cylindrical through whole 123 bored in bearing 12. The flat upper face of flange 113 rotates smoothly beneath the flat lower face of substrate 122 with friction—both faces are applied with the grease of high viscosity. Shaft 11 can thus obtain predetermined torque.

Pole 116 is press-fitted into hole 142 provided on frictional plate 14 so that pole 116 can move axially by the force not less than biasing force of spring 13, and yet, spring 13 and plate 14 do not come off from pole 116 by the weights of spring 13 and plate 14. Pole 116 has extended through the center of spring 13 downward from the bottom of recess 115 provided in shaft 11. This construction allows frictional plate 14 to follow the rotation of shaft 11 at rotary operation. It also allows a play angle—in the rotational direction and appeared at the section with which plate 14 engages for moving axially and independently of shaft 11—to be restricted not wider than an allowable level. As a result, a rotary type electronic component with excellent tactile feel is achieved, and the component can be assembled with ease by preventing spring 13 and frictional plate 14 from coming off from recess 115 provided in shaft 11.

In the manufacturing method of this rotary type electronic component, shaft 11, spring 13 and frictional plate 14 are integrated in advance by the following way: First, compress spring 13 housed in recess 115. Second, extend pole 116 from inner part of recess 115 passing through the center of spring 13 and extending through hole 142 bored in frictional plate 14 which engages with the rim of the recess opening so that plate 14 closes the opening. Finally, widen the end of pole 116 by caulking to form a stopper preventing spring 13 and plate 14 from coming off. As such, spring 13 and plate 14 are mounted inside recess 115 of shaft 11. This mounting process has been the most intricate process among other processes. The steps discussed above thus improve the efficiency of entire assembling work of the rotary type electronic component. This also aids in realizing an automated assembly.

According to the present invention discussed above, the spring urges the frictional plate against the bottom plate of case and the flat flange of shaft against the flat substrate of bearing with grease in between respectively. This construction allows the flange and substrate to solidly contact with each other in a wide area with friction at rotational operation so that the shaft can obtain high and stable torque with smooth tactile feel. The spring is housed in the recess provided in the cylindrical section of shaft, which avoids increasing the outer diameter and realizes a long service life of the component.

What is claimed is:

1. A rotary type electronic component of the present invention comprising:

(a) a bearing comprising:
  a cylinder section; and
  a substrate on which the cylinder section is rested, (b) a rotary shaft comprising:
  an upper section protruding from the bearing;
  a mid section journaled by the bearing; and
  a lower section comprising:
    a flange formed around the lower section;
    a hole extending through the flange; and
    a movable contact disposed on a lower face of the flange,
    recess axially provided therein and communicating with the hole through the flange;

(c) a case coupling to a lower face of the substrate of the bearing so that the case covers the lower section of the rotary shaft, and having a fixed contact on a bottom plate corresponding to the movable contact;

(d) a spring being housed by the recess of the rotary shaft (e) a frictional plate having a hole extending therethrough axially, engaging with an inlet circumference of the recess prepared in the rotary shaft, bearing against the bottom plate of the case by the spring force, and rotating together with the rotary shaft; however, being axially movable independently of the rotary shaft.

2. The rotary type electronic component as defined in claim 1 further comprising a pole standing on a bottom of said recess, wherein said pole extends through said spring and is press-fitted into the hole of said frictional plate for moving said frictional plate axially by a force not less than a biasing force of said spring with weights of said spring and said frictional plate being insufficient to come off said spring and said frictional plate from said pole.

3. The rotary type electronic component as defined in claim 2 wherein lubricant is applied respectively between said rotary shaft and said bearing as well as between an upper face of said flange and a lower face of the substrate.

4. The rotary type electronic component as defined in claim 3 further comprising a partition disposed on the bottom plate of said case and between a contact section of a lower face of said frictional plate with the bottom plate of said case and a section where the fixed contacts are prepared, and wherein lubricant is applied on a contact face between the lower face of said frictional plate and the bottom plate of said case.

5. The rotary type electronic component as defined in claim 1 wherein lubricant is applied respectively between said rotary shaft and said bearing as well as between an upper face of said flange and a lower face of the substrate.

6. The rotary type electronic component as defined in claim 5 further comprising a partition disposed on the bottom plate of said case and between a contact section of a lower face of said frictional plate with the bottom plate of said case and a section where the fixed contacts are prepared, and wherein lubricant is applied on a contact face between the lower face of said frictional plate and the bottom plate of said case.

7. The rotary type electronic component as defined in claim 1 wherein the lower face of the substrate of said bearing has a flat section, and the upper face of said flange has a flat section, and wherein both the flat sections relatively rotate with friction by a rotation of said shaft.

8. The rotary type electronic component as defined in claim 7 wherein lubricant is applied between both the two flat sections.

9. A method of manufacturing a rotary type electronic component comprising:

(a) a bearing comprising:
  a cylinder section; and
  a substrate on which the cylinder section is rested, (b) a rotary shaft comprising:
  an upper section protruding from the bearing;
  a mid section journaled by the bearing; and
  a lower section comprising:
    a flange formed around the lower section;
    a hole extending through the flange; and
    a movable contact disposed on a lower face of the flange,
    a recess axially disposed therein and communicating with the hole through the flange;

(c) a case coupling to a lower face of the substrate of the bearing so that the case covers the lower section of the rotary shaft, and having a fixed contact on a bottom plate corresponding to the movable contact;

(d) a spring housed by the recess of the rotary shaft (e) a frictional plate having a hole extending therethrough axially, engaging with an inlet circumference of the recess prepared in the rotary shaft, bearing against the bottom plate of the case by the spring force, and rotating together with the rotary shaft; however, being axially movable independently of the rotary shaft; and (f) a pole standing on the bottom of the recess provided in said rotary shaft wherein said pole extends through said spring and is press-fitted into the hole of said frictional plate for moving said frictional plate axially by a force not less than a biasing force of said spring and yet weights of said spring and said frictional plate are insufficient to come off thereof from said pole, wherein said method comprising the steps of:
  extending said pole through the hole bored in said frictional plate;
  compressing said spring; and
  widening an end of said pole to form a stopper preventing said pole from coming off from the hole for integrating said rotary shaft, said spring and said frictional plate.

10. The method of manufacturing the rotary type electronic component as defined in claim 9 wherein lubricant is applied respectively between said rotary shaft and said bearing as well as between an upper face of said flange and a lower face of said substrate of said bearing.

11. The method of manufacturing the rotary type electronic component as defined in claim 9 wherein said component further comprises a partition disposed on the bottom plate of said case and between a contact section of a lower face of said frictional plate with the bottom plate of said case and a section where the fixed contacts are prepared, said method further comprising the step of applying lubricant between a lower face of said frictional plate and the bottom plate of said case.

* * * * *